US011988008B2

(12) United States Patent
Xu et al.

(10) Patent No.: US 11,988,008 B2
(45) Date of Patent: May 21, 2024

(54) CONNECTING ASSEMBLY FOR CANOPIES

(71) Applicant: Wuyi Shenhua Industry & Trade Co., Ltd., Jinhua (CN)

(72) Inventors: Heng Xu, Jinhua (CN); Zhuonan Zhu, Jinhua (CN)

(73) Assignee: Wuyi Shenhua Industry & Trade Co., Ltd., Jinhua (CN)

( * ) Notice: Subject to any disclaimer, the term of this patent is extended or adjusted under 35 U.S.C. 154(b) by 281 days.

(21) Appl. No.: 17/702,857

(22) Filed: Mar. 24, 2022

(65) Prior Publication Data

US 2023/0295931 A1 Sep. 21, 2023

(30) Foreign Application Priority Data

Mar. 17, 2022 (CN) ..... 202220583553.4

(51) Int. Cl.

| | |
|---|---|
| ***E04H 15/50*** | (2006.01) |
| ***E04F 10/02*** | (2006.01) |
| ***E04H 15/28*** | (2006.01) |
| ***E04H 15/34*** | (2006.01) |
| ***E04H 15/58*** | (2006.01) |

(52) U.S. Cl.

CPC ..... *E04H 15/50* (2013.01); *E04F 10/02* (2013.01); *E04H 15/28* (2013.01); *E04H 15/34* (2013.01); *E04H 15/58* (2013.01)

(58) Field of Classification Search

CPC ..... E04H 15/50; E04H 15/58; E04H 15/34; E04H 15/28

See application file for complete search history.

(56) References Cited

U.S. PATENT DOCUMENTS

| | | | | |
|---|---|---|---|---|
| 8,789,551 | B2 * | 7/2014 | Dotterweich | E04H 15/50 135/147 |
| 8,893,737 | B2 * | 11/2014 | Yang | E04H 15/48 135/144 |
| 9,901,149 | B2 * | 2/2018 | Arndt | E04H 15/28 |
| 9,926,720 | B2 * | 3/2018 | Huang | E04H 15/54 |
| 10,113,329 | B2 * | 10/2018 | Choi | E04H 15/46 |
| 10,119,297 | B2 * | 11/2018 | Choi | E04H 15/50 |
| 10,280,645 | B1 * | 5/2019 | Yang | E04H 15/50 |
| 10,309,121 | B2 * | 6/2019 | Choi | E04H 15/50 |
| 10,982,466 | B2 * | 4/2021 | Huang | E04H 15/50 |
| 11,072,943 | B2 * | 7/2021 | Sun | E04H 15/32 |
| 11,230,858 | B2 * | 1/2022 | Yuan | E04H 15/48 |
| 2007/0221262 | A1 * | 9/2007 | Tsai | E04H 15/50 135/145 |
| 2018/0106068 | A1 * | 4/2018 | Choi | E04H 15/46 |

* cited by examiner

*Primary Examiner* — Noah Chandler Hawk
(74) *Attorney, Agent, or Firm* — Birchwood IP

(57) ABSTRACT

A connection assembly for an overhanging canopy comprises a support column and a connection adjustment mechanism. The connection adjustment mechanism is arranged on the support column. The connection adjustment mechanism includes a fixed block and a movable block. The fixed block is arranged on the top of the support column, and the rear side of the top of the fixed block is arranged with a mounting block, the inner wall of the mounting block is arranged with a connecting rod, the right side of the connecting rod penetrates the mounting block and extends to the outside of the mounting block, a limit frame is arranged on the front of the mounting block.

4 Claims, 4 Drawing Sheets

CONNECTING ASSEMBLY FOR CANOPIES

CROSS-REFERENCE TO RELATED APPLICATIONS

This application claims the benefit and priority of Chinese patent application No. 202220583553.4, filed on Mar. 17, 2022, disclosure of which is hereby incorporated by reference in its entirety.

TECHNICAL FIELD

The present application relates to the technical field of canopies, in particular to a connecting assembly for canopies.

BACKGROUND

The canopy assembly is usually the supporting and fixing assembly when the awning and the canopy are propped up. The supporting and fixing components usually need to be fully opened by adjusting rods. However, when the traditional canopy assembly is telescopically opened, the canopy assembly needs to be fully opened with the help of external adjusting rods, and several actions are required to fully open the canopy. At the same time, because the adjusting rod and the whole assembly are not fixed in one structure, the adjusting rod is easy to be lost in the later stage, which makes it inconvenient to completely open the canopy assembly. This greatly reduces practicality and brings great inconvenience to users. At the same time, there is also a risk of not being able to find or losing single parts.

SUMMARY

The purpose of the present application is to provide a connecting assembly for a canopy, so as to solve the above-mentioned problems in the background art.

In order to achieve the above purpose, the present application provides the following technical solutions: a connection assembly for an overhanging canopy, comprising a support column and a connection adjustment mechanism, and the connection adjustment mechanism is arranged on the support column;

The connection adjustment mechanism comprises a fixed block and a movable block, the fixed block is arranged on the top of the support column, and a mounting block is arranged on the rear side of the top of the fixing block, a connecting rod is arranged on the inner wall of the mounting block, and the right side of the connecting rod is configured to penetrate the mounting block and extend to the outside thereof, a limiting frame is arranged on the front of the mounting block, an adjusting rod is arranged on the left side of the limiting frame, a positioning sleeve is arranged on the right side of the surface of the connecting rod, and the right end of the adjusting rod is configured to sequentially penetrate the limiting frame and the positioning sleeve from left to right and extend to the interior of the positioning sleeve, the right side of the adjusting rod is configured to movably connect with the driving block through the movable rotating shaft, and the bottom of the driving block is configured to penetrate the positioning sleeve and extend to the outside thereof, a first rotating shaft is arranged on the bottom of the front of the driving block, a surface of the first rotating shaft is movably connected with a mounting sleev, and a mounting rod is arranged at right side of the mounting sleeve, the left end of the mounting rod is configured to penetrate the mounting sleeve and extend to the outside thereof, the movable block is slidably connected to the surface of the support column, the back side of the right side of the movable block is movably connected with the mounting rod through the second rotating shaft, third rotating shafts are arranged on the back and right side of the fixed block and the back and right side of the movable block, and the two third rotating shafts on the same side are movably connected by folding telescopic rods.

Preferably, the bottom of the positioning sleeve is configured to be in an open state.

Preferably, the surface of the adjusting rod is configured to be in contact with the inner wall of the positioning sleeve.

Preferably, the front surface of the mounting sleeve is threadedly connected to the mounting rod through a fixing bolt.

Preferably, the left and right sides and the bottom of the limiting frame are configured to be in an open state.

Preferably, the bottom of the limiting frame is configured to fixedly connect with the top of the fixing block.

Preferably, the bottom section of the surface of the support column is sleeved with an anti-skid pad.

Compared with the prior art, the beneficial effects of the present application are as follows:

Through the mutual cooperation between the fixed block, the movable block, the mounting block, the connecting rod, the limit frame, the adjusting rod, the positioning sleeve, the movable shaft, the driving block, the first rotating shaft, the mounting sleeve, the mounting rod, the second rotating shaft, the third rotating shaft and the folding telescopic rod, the present application makes the adjustment mechanism and the whole assembly in an integrated state, so that the whole shelf can be opened and folded in one step. This does not require additional actions, and the operation is convenient, greatly improves practicability, and brings great convenience to users.

1 support column, 2 connection adjustment mechanism, 21 fixed block, 22 movable block, 23 mounting block, 24 connecting rod, 25 limit frame, 26 adjusting rod, 27 positioning sleeve, 28 movable shaft, 29 driving block, 210 first rotating shaft, 211 mounting sleeve, 212 mounting rod, 213 second rotating shaft, 214 third rotating shaft, 215 folding telescopic rod, 3 fixing bolt, 4 anti-skid pad.

DETAILED DESCRIPTION

The technical solutions in the embodiments of the present application will be clearly and completely described below with reference to the drawings in the embodiments of the present application. Obviously, the described embodiments are only a part of the embodiments of the present application, but not all of the embodiments. Based on the embodiments in the present application, all other embodiments obtained by those of ordinary skill in the art without creative efforts shall fall within the protection scope of the present application.

Figure 1:
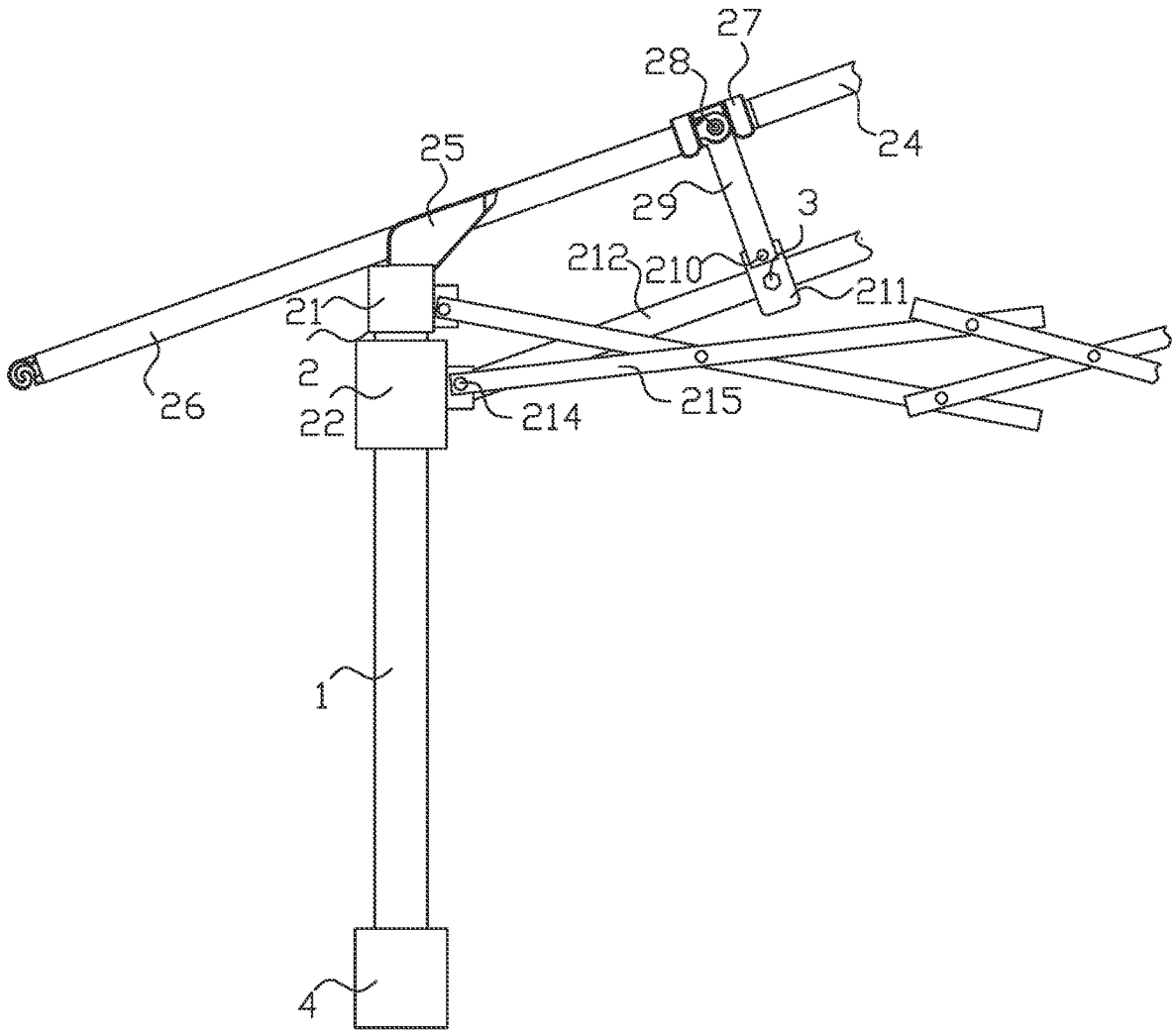
FIG. 1 is a schematic structural diagram of the front view of the application.
Figure 2:
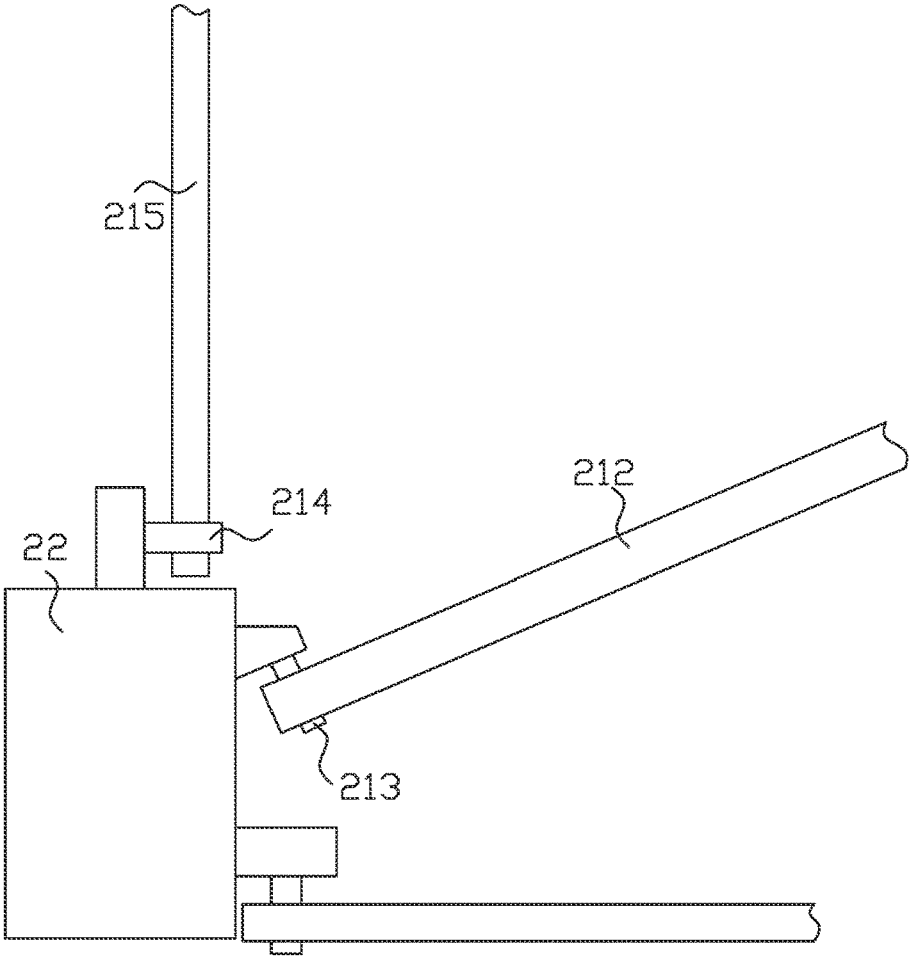
FIG. 2 is a schematic structural diagram of a top view of the movable block, the mounting rod, the second rotating shaft, the third rotating shaft and the folding telescopic rod of the present application.
Figure 3:
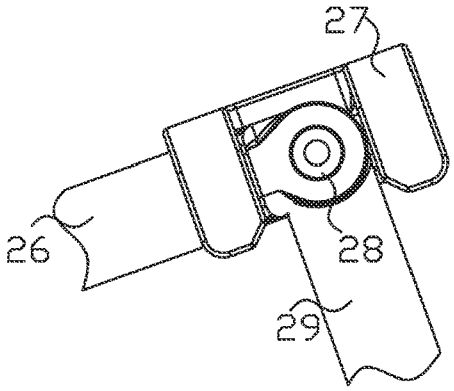
FIG. 3 is a schematic structural diagram of the front view of the adjusting rod, the positioning sleeve, the movable rotating shaft and the driving block of the present application.
Figure 4:
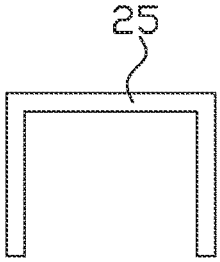
FIG. 4 is a schematic structural diagram of the left side view of the limiting frame of the present application.
Figure 5:
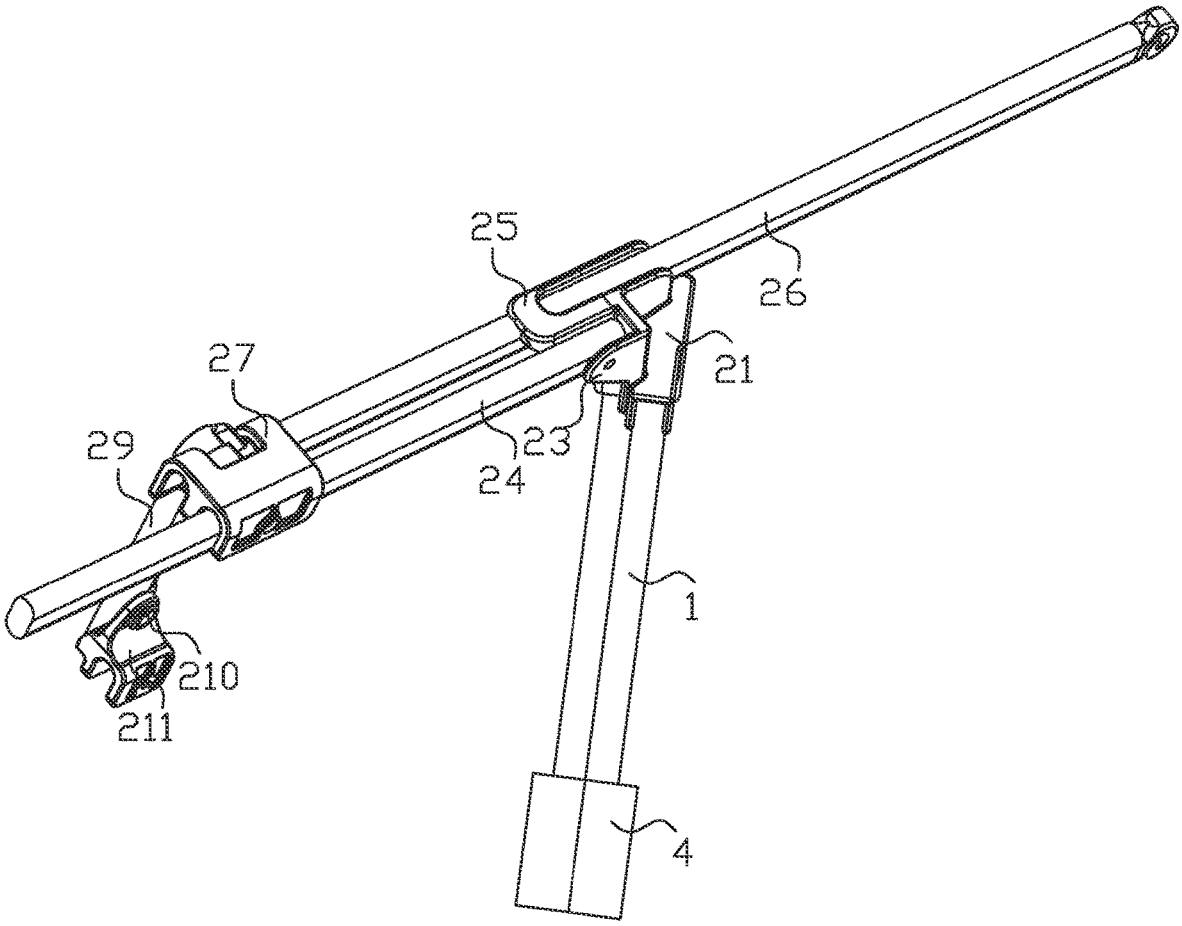
FIG. 5 is a schematic three-dimensional structure diagram of the rear view of the present application after the support column, the fixing block and the mounting sleeve are connected to each other.
Figure 6:
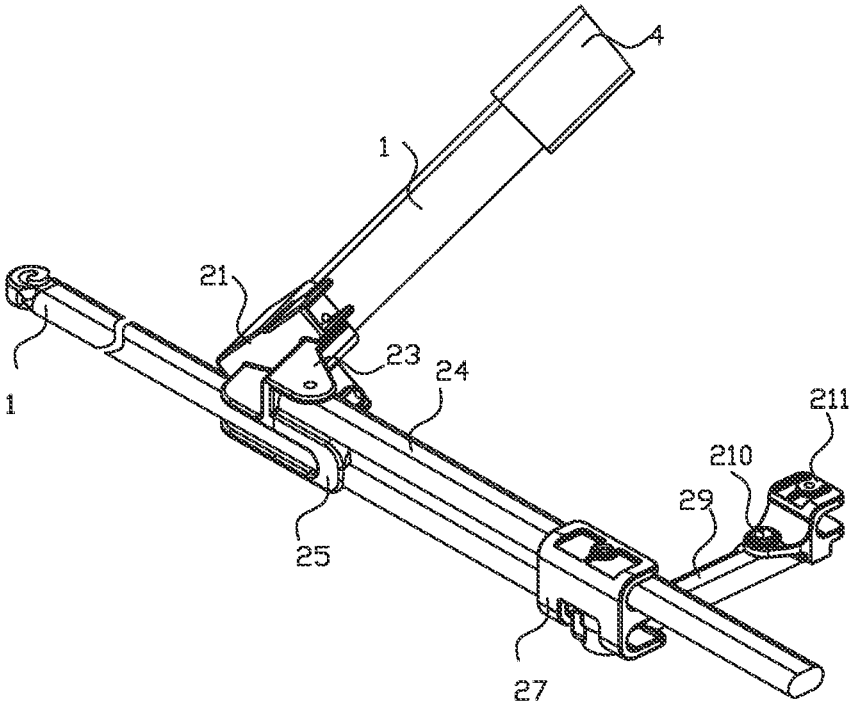
FIG. 6 is a schematic three-dimensional structural diagram of a side view of the present application after the support column, the fixing block and the mounting sleeve are connected to each other.

Please refer to FIGS. 1-6, a connecting assembly for a canopy, comprising a support column 1 and a connection adjustment mechanism 2, the connection adjustment mechanism 2 is arranged on the support column 1, and the bottom section of the surface of the support column 1 is sleeved with an anti-skid pad 4. By arranging the anti-skid pad 4, the stability and anti-skid performance when placing the support column 1 are improved.

The connection adjustment mechanism 2 comprises a fixed block 21 and a movable block 22, the fixed block 21 is arranged on the top of the support column 1, and a mounting block 23 is arranged on the rear side of the top of the fixing block 21, a connecting rod 24 is arranged on the inner wall of the mounting block 23, and the right side of the connecting rod 24 is configured to penetrate the mounting block 23 and extend to the outside thereof, a limiting frame 25 is arranged on the front of the mounting block 23, wherein the left and right sides and the bottom of the limiting frame 25 are configured to be in an open state and the bottom of the limiting frame 25 is configured to fixedly connect with the top of the fixing block 21. An adjusting rod (26) is arranged on the left side of the limiting frame 25, a positioning sleeve 27 is arranged on the right side of the surface of the connecting rod 24, wherein the bottom of the positioning sleeve 27 is configured to be in an open state. The right end of the adjusting rod 26 is configured to sequentially penetrate the limiting frame 25 and the positioning sleeve 27 from left to right and extend to the interior of the positioning sleeve 27, wherein the surface of the adjusting rod 26 is configured to be in contact with the inner wall of the positioning sleeve 27. The right side of the adjusting rod 26 is configured to movably connect with the driving block 29 through the movable rotating shaft 28, and the bottom of the driving block 29 is configured to penetrate the positioning sleeve 27 and extend to the outside thereof, a first rotating shaft 210 is arranged on the bottom of the front of the driving block 29, a surface of the first rotating shaft 210 is movably connected with a mounting sleeve 211, and a mounting rod 212 is arranged at right side of the mounting sleeve 211, the left end of the mounting rod 212 is configured to penetrate the mounting sleeve 211 and extend to the outside thereof, wherein the front surface of the mounting sleeve 211 is threadedly connected to the mounting rod 212 through a fixing bolt 3. The movable block 22 is slidably connected to the surface of the support column 1. The back side of the right side of the movable block 22 is movably connected with the mounting rod 212 through the second rotating shaft 213. Third rotating shafts 214 are arranged on the back and right side of the fixed block 21 and the back and right side of the movable block 22, and the two third rotating shafts 214 on the same side are movably connected by folding telescopic rods 215. Through the mutual cooperation between the fixed block 21, the movable block 22, the mounting block 23, the connecting rod 24, the limit frame 25, the adjusting rod 26, the positioning sleeve 27, the movable shaft 28, the driving block 29, the first rotating shaft 210, the mounting sleeve 211, the mounting rod 212, the second rotating shaft 213, the third rotating shaft 214 and the folding telescopic rod 215, the present application makes the adjustment mechanism and the whole assembly in an integrated state, so that the whole shelf can be opened and folded in one step. This does not require additional actions, and the operation is convenient, greatly improves practicability, and brings great convenience to users.

During use, when the folding telescopic rod 215 needs to be stretched, the adjusting rod 26 is pulled upward by the left side of the adjusting rod 26. The right side of the adjusting rod 26 drives the driving block 29 to move downward by the movable shaft 28, so that the adjusting rod 26 and the positioning sleeve 27 are separated. The adjusting rod 26 drives the mounting sleeve 211 to move downward by the first rotating shaft 210, and the mounting sleeve 211 drives the movable block 22 to slide downward by the mounting rod 212 and the second rotating shaft 213. The movable block 22 drives the two third rotating shafts 214 located at the bottom to move downward, so that the two third rotating shafts 214 on the same side move away from each other, so that the folding telescopic rod 215 is stretched.

To sum up: through the mutual cooperation between the fixed block 21, the movable block 22, the mounting block 23, the connecting rod 24, the limit frame 25, the adjusting rod 26, the positioning sleeve 27, the movable shaft 28, the driving block 29, the first rotating shaft 210, the mounting sleeve 211, the mounting rod 212, the second rotating shaft 213, the third rotating shaft 214 and the folding telescopic rod 215, the assembly for a canopy solves the problems raised in the above-mentioned background art.

Although the embodiments of the present application have been shown and described, it will be understood by those skilled in the art that various changes, modifications, and substitutions can be made in these embodiments without departing from the principles and spirit of the present application, the scope of this application is defined by the appended claims and their equivalents.

What is claimed is:

1. A connection assembly for an overhanging canopy, comprising a support column (1) and a connection adjustment mechanism (2), wherein the connection adjustment mechanism (2) is arranged on the support column (1);

the connection adjustment mechanism (2) comprises a fixed block (21) and a movable block (22), the fixed block (21) is arranged on the top of the support column (1), and a mounting block (23) is arranged on the rear side of the top of the fixing block (21), a connecting rod (24) is arranged on the inner wall of the mounting block (23), and the right side of the connecting rod (24) is configured to penetrate the mounting block (23) and extend to the outside thereof, a limiting frame (25) is arranged on the front of the mounting block (23), an adjusting rod (26) is arranged on the left side of the limiting frame (25), a positioning sleeve (27) is arranged on the right side of the surface of the connecting rod (24), and the right end of the adjusting rod (26) is configured to sequentially penetrate the limiting frame (25) and the positioning sleeve (27) from left to right and extend to the interior of the positioning sleeve (27), the right side of the adjusting rod (26) is configured to movably connect with the driving block (29)

through the movable rotating shaft (28), and a top of the driving block (29) is configured to penetrate the positioning sleeve (27) and extend to the outside thereof, a first rotating shaft (210) is arranged on a bottom of the driving block (29), a surface of the first rotating shaft (210) is movably connected with a mounting sleeve (211), and a mounting rod (212) is arranged at right side of the mounting sleeve (211), the left end of the mounting rod (212) is configured to penetrate the mounting sleeve (211) and extend to the outside thereof, the movable block (22) is slidably connected to the surface of the support column (1), the back side of the right side of the movable block (22) is movably connected with the mounting rod (212) through the second rotating shaft (213), third rotating shafts (214) are arranged on the back and right side of the fixed block (21) and the back and right side of the movable block (22), and the two third rotating shafts (214) on the same side are movably connected by folding telescopic rods (215);

wherein the bottom of the positioning sleeve (27) is configured to be in an open state;

wherein the surface of the adjusting rod (26) is configured to be in contact with the inner wall of the positioning sleeve (27);

wherein the front surface of the mounting sleeve (211) is threadedly connected to the mounting rod (212) through a fixing bolt (3).

2. The connecting assembly for an overhang canopy according to claim 1, wherein the left and right sides and the bottom of the limiting frame (25) are configured to be in an open state.

3. The connecting assembly for an overhang canopy according to claim 2, wherein the bottom of the limiting frame (25) is configured to fixedly connect with the top of the fixing block (21).

4. The connecting assembly for an overhang canopy according to claim 3, wherein the bottom section of the surface of the support column (1) is sleeved with an anti-skid pad (4).

* * * * *